US011738912B2

(12) United States Patent
Craig et al.

(10) Patent No.: US 11,738,912 B2
(45) Date of Patent: Aug. 29, 2023

(54) PACKAGING FOR AUTOMATED CLOSURE AND PROCESS THEREFOR

(71) Applicant: PUNCHBOWL PACKAGING LIMITED, Pukekohe (NA)

(72) Inventors: Shane Craig, Pukekohe (NZ); Mark Frances Roche, Pukekohe (NZ)

(73) Assignee: PUNCHBOWL PACKAGING LIMITED, Pukekohe (NZ)

( * ) Notice: Subject to any disclaimer, the term of this patent is extended or adjusted under 35 U.S.C. 154(b) by 0 days.

(21) Appl. No.: 17/628,081

(22) PCT Filed: Jul. 20, 2020

(86) PCT No.: PCT/NZ2020/050070
§ 371 (c)(1),
(2) Date: Jan. 18, 2022

(87) PCT Pub. No.: WO2021/010844
PCT Pub. Date: Jan. 21, 2021

(65) Prior Publication Data

US 2022/0258926 A1 Aug. 18, 2022

(30) Foreign Application Priority Data

Jul. 18, 2019 (AU) ..... 2019902546

(51) Int. Cl.
*B65D 43/02* (2006.01)
*B65B 7/28* (2006.01)
*B65D 51/24* (2006.01)

(52) U.S. Cl.
CPC ..... *B65D 43/0229* (2013.01); *B65B 7/2828* (2013.01); *B65D 51/248* (2013.01);
(Continued)

(58) Field of Classification Search
CPC .. B65D 85/00; B65D 43/0229; B65D 51/248; B65D 2543/00092; B65D 2543/00518;
(Continued)

(56) References Cited

U.S. PATENT DOCUMENTS 3,628,307 A 12/1971 Croasdale
4,793,451 A 12/1988 Taylor
(Continued)

FOREIGN PATENT DOCUMENTS

GB 2287015 A 9/1995
JP S5583475 U 6/1980
(Continued)

OTHER PUBLICATIONS

Salindo, Ericson (Authorized Officer), International Preliminary Report on Patentability dated Nov. 9, 2021, International Application No. PCT/NZ2020/050070, 23 pages (including Response to Written Opinion).

*Primary Examiner* — Kareen K Thomas
(74) *Attorney, Agent, or Firm* — MH2 TECHNOLOGY LAW GROUP LLP

(57) ABSTRACT

The closure adapted to cover a container aperture defines a retention projection dimensioned to be received in a retention aperture in a wall of the container. An insertion surface on the projection avoids the closure being impeded by an edge of the wall. The projection defines a disengagement surface to remove the projection from the retention aperture and defines a registering surface opposite the registering surface. The closure may be fitted agnostic to the rotational alignment of the closure relative to wall and then twisted relative to the container until resistance is provided by the registering surfaces engaging Automated closure requires only two degrees of movement and only two force sensors.

9 Claims, 7 Drawing Sheets

(52) U.S. Cl.
CPC ..... *B65D 2543/00092* (2013.01); *B65D 2543/00518* (2013.01); *B65D 2543/00546* (2013.01); *B65D 2543/00574* (2013.01)

(58) Field of Classification Search
CPC ..... B65D 2543/00546; B65D 2543/00574; B65D 43/021; B65D 41/0471; B65D 41/0485; B65D 43/0225; B65B 7/2828; B65B 7/2807; B67B 3/00
See application file for complete search history.

(56) References Cited

U.S. PATENT DOCUMENTS 8,925,755 B2 * 1/2015 Lesquir ..... B65D 43/0249 220/266
2007/0131738 A1 6/2007 Erdie
2008/0277418 A1 * 11/2008 Vockler ..... B65D 43/0212 222/111
2009/0014456 A1 * 1/2009 Woinarski ..... B44D 3/127 220/790
2009/0026203 A1 * 1/2009 Selina ..... B65D 43/0256 220/276
2009/0134160 A1 * 5/2009 Alvares ..... B65D 1/46 220/200
2009/0159607 A1 * 6/2009 Kratzer ..... B44D 3/128 220/849
2009/0314780 A1 * 12/2009 Selina ..... B65D 43/0256 220/780
2010/0038364 A1 * 2/2010 Woinarski ..... B65D 43/0237 220/780
2010/0044389 A1 * 2/2010 Logue ..... B65D 51/249 264/340
2010/0108705 A1 * 5/2010 De Jesus ..... B65D 43/0249 220/789
2010/0127003 A1 * 5/2010 Alvares ..... B65D 43/021 220/669
2010/0147851 A1 * 6/2010 Blumenschein ... B65D 43/0254 220/266
2010/0200605 A1 * 8/2010 Herring ..... B65D 43/0212 220/780
2016/0130050 A1 5/2016 St. Clair

FOREIGN PATENT DOCUMENTS

JP H11105898 A 4/1999
WO 2012092989 A1 7/2012
WO 2013109174 A1 7/2013

* cited by examiner

PACKAGING FOR AUTOMATED CLOSURE AND PROCESS THEREFOR

CROSS-REFERENCE TO RELATED APPLICATIONS

The present application claims the benefit of priority of International Patent Application No. PCT/NZ2020/050070, filed on Jul. 20, 2020, the disclosure of which is incorporated by reference herein in its entirety.

This invention relates to improvements in respect of closures for containers, such as closures for tubular containers. Specifically, this invention relates to improvements in closures for containers where the closure is fixed and/or released from the container in an actuation movement comprising a twist.

BACKGROUND OF THE INVENTION

A common type of container for items has a tube which is plugged with a closure. This type of container has an advantage that they are easily opened by linear movement of the plug away from the tube. A disadvantage of this type of container is that the plug may not be securely held in the tube and the tube may not be securely closed.

It would be of advantage to have a container which could address any or all of the above problems, or at least provide the public with an alternative choice.

DISCLOSURE OF THE INVENTION

In one aspect the present invention provides a container comprising a wall and a closure, wherein the wall defines a container aperture to receive items into a contained region, wherein the closure is adapted to cover the container aperture to close the container, wherein the wall defines a retention aperture and the closure defines a retention projection dimensioned to be received in the retention aperture to retain the closure over the container aperture when a retention surface defined by the retention projection engages a retention surface defined by the wall at an edge of the retention aperture, wherein the retention projection defines an insertion surface which provides an inclined surface to avoid the closure being impeded by an edge of the wall in a direction towards the contained region, the insertion surface being located on the retention projection opposite a retention surface arranged to engage the wall at an edge of the retention aperture, wherein the retention projection defines a disengagement surface adapted to remove the retention projection from the retention aperture as the closure is twisted in a first direction relative to the wall, and wherein the retention projection defines a registering surface arranged transverse to the retention surface to engage a registering surface defined by the wall at another edge of the retention aperture, wherein the disengagement surface is located on the retention projection opposite the registering surface.

The insertion surface may be inclined radially outward from the closure in a direction opposite to a closure direction in which the closure is moved relative to the wall to close the container, and wherein the inclined surface provides a ramp to facilitate the retention projection sliding past an edge of the wall as the closure is moved towards the contained region.

The inclined disengagement surface defined by the retention projection may be located on the retention projection opposite the registering surface.

The registering surface defined by the retention aperture may be provided by an edge of the retention aperture and the engagement surface defined by the retention projection may be an edge of the retention projection.

The registering surface defined by the retention projection may be arranged to abut the registering surface when the engagement surface defined by the retention aperture is aligned with the retention surface defined by the retention aperture.

The disengagement surfaces and registering surfaces may allow the closure to be twisted relative to the wall only in the first direction in which twisting from a relative position with the retention projection and retention aperture aligned will disengage the retention projection from the retention aperture to allow further twisting and wherein twisting in the second direction from a relative position with the retention projection and retention aperture aligned will abut the registering surface of the engagement projection and the engagement aperture to resist further rotation.

The container may be closed by covering the container aperture with a closure process which is agnostic to the rotational alignment of the closure relative to container and twisting the closure relative to the container until resistance is provided by the registering surfaces engaging.

In one aspect the invention provides a container comprising:

a wall defining a container aperture adapted to allow items to be received in a container region, a closure adapted to cover the container aperture when located over the closure aperture to close the container;

a first retention surface formed on one of the wall or the closure;

a second retention surface formed on the other of the wall or closure and adapted to engage the first retention surface to retain the closure against movement in a direction away from the contained region;

and wherein the second projection has a disengagement surface arranged transverse to the second retention surface, wherein the disengagement surface is adapted to allow the second retention surface of the container to slide to a location past the first retention surface when the closure is twisted relative to the wall so that the first and second retention surfaces do not engage.

The disengagement surface may comprise a surface inclining away from the centre of the container region to allow twisting of the closure relative to the wall to slide the second retention surface to a location past the first retention surface.

The first retention surface may be formed by an aperture on one or other of the wall or closure and the second retention surface may be formed by a projection on the other of the wall or closure.

The inclined disengagement surface may be arranged to remove the projection from the aperture as the closure is twisted relative to the wall in a first direction of rotation to allow the projection to move relatively past the aperture.

The disengagement surface may comprise a ramp defined on a side of the retention projection opposite the registering surface.

The container may comprise a first registering surface formed on one or other of the closure or wall and a second registering surface formed on the other of the closure or wall, wherein the first and second registering surfaces are arranged such that when the first retention surface is engaged with the second retention surface the first registering surface and second registering surface impede twisting of the closure relative to the wall in a second direction of rotation. This may provide a registering feedback to indicate that the first and second retention surfaces are aligned to engage against removal of the closure from the container aperture. The feedback may be a resistive force.

The container may comprise an insertion surface operable to allow the first engagement surface to move relatively past the second engagement surface as the closure is moved in a direction towards an interior of the container to allow the first engagement surface and second engagement surface to engage each other.

The insertion surface may comprise a ramp defined on a side of the retention projection opposite the retention surface.

The container may comprise a first alignment surface on the wall and a second alignment surface on the closure, wherein the first and second alignment surfaces are adapted to engage when the closure is pushed towards an interior of the container to align the retention projection and retention aperture so as to allow insertion of the retention projection into the retention aperture by the closure being twisted relative to the wall.

The first alignment surface may be a lip formed on the closure.

The second alignment surface may be an edge of the wall.

The wall may be formed of a sheet of material.

The wall may comprise a sheet of material arranged into a tube.

The wall may be formed of transparent material.

In another aspect, the invention provides a process of closing a container comprising a wall defining a container aperture for a contained region and a closure for the container aperture. The process comprising of the steps: the apparatus aligning the closure with the container aperture; pressing the closure axially towards the interior of the contained region until a lip defined by the closure abuts the wall to provide a force resisting further movement of the closure towards the contained region defined by the wall; the apparatus twisting the closure relative to the wall until abutment of registering surfaces defined by the closure and wall abut to provide a force resisting further twisting.

The process may comprise the steps of removing the closure from a stack of closures and retaining the closure on a holding element.

The process may comprise releasing the closure from the holding element when a force resisting further twisting is provided by abutment of the registering surfaces.

In one aspect the present invention provides closure arranged to close a container having a wall which defines a contained region and retention aperture, wherein the retention aperture provides a retention surface and a registering surface, wherein the closure is adapted to cover the container aperture to close the container, wherein the closure defines a retention projection dimensioned to be received in the retention aperture to retain the closure over the container aperture when a retention surface defined by the retention projection engages a retention surface defined by the wall at an edge of the retention aperture, wherein the retention projection defines an insertion surface which provides a ramp to avoid the closure being impeded by an edge of the wall in a direction towards the contained region, the insertion surface being located on the retention projection opposite a retention surface arranged to engage the wall at an edge of the retention aperture, wherein the retention projection defines a disengagement surface which provides a ramp to remove the retention projection from the retention aperture as the closure is twisted in a first direction relative to the wall, and wherein the retention projection defines a registering surface arranged transverse to the retention surface to engage a registering surface defined by the wall at another edge of the retention aperture, wherein the disengagement surface is located on the retention projection opposite the registering surface.

A further aspect of the invention provides a container substantially as herein described and illustrated with reference to FIGS. 1 to 6.

A further aspect of the invention provides a closure substantially as herein described and illustrated with reference to FIGS. 1 to 6.

A further aspect of the invention provides a container substantially as herein described and illustrated with reference to FIGS. 7 to 11.

A further aspect of the invention provides a closure substantially as herein described and illustrated with reference to FIGS. 7 to 11.

A further aspect of the invention provides an apparatus process for closing a container substantially as herein described and illustrated with reference to FIG. 12.

A further aspect of the invention provides a process of closing a container substantially as herein described and illustrated with reference to FIG. 13.

BRIEF DESCRIPTION OF THE DRAWINGS

Additional and further aspects of the present invention will be apparent to the reader from the following description of embodiments, given in by way of example only, with reference to the accompanying drawings in which.

Further aspects of the invention will become apparent from the following description of the invention which is given by way of example only of particular embodiments.

BEST MODES FOR CARRYING OUT THE INVENTION

Figure 1:
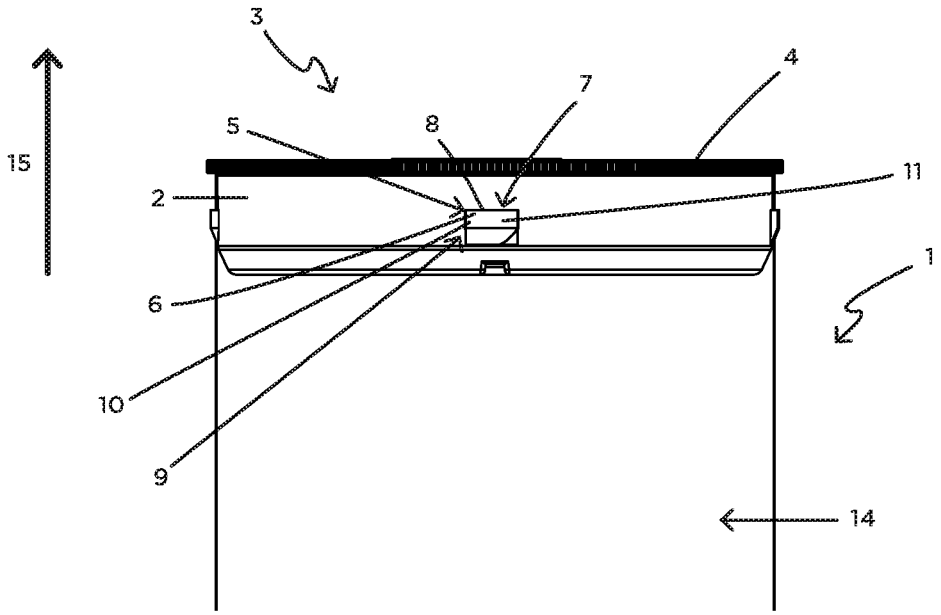
FIG. 1 shows a side elevation of a container with closure of an embodiment of the present invention.

FIG. 1 shows a side elevation of a container 1 according to an embodiment of the invention. The container has a wall 2 which defines a container aperture 3 through which items can be received into the container. In this example, the wall 2 is formed into a tube to define a contained region for items.

As shown the container 1 has a closure 4 which is able to cover the container aperture 3 to close the container 1.

FIG. 1 shows a retention aperture 5. Also shown is a retention projection 6 which is received in the retention aperture. The wall defines a retention surface 7. In this example the retention surface 7 is an edge of the wall defining a border of the aperture 5. The closure also defines a retention surface 8 as a surface formed on the retention projection 6. When the retention projection 6 is received in the retention aperture 5 retention surfaces 7 and 8 engage against movement of the closure 4 in a direction out and away from the container aperture 3, shown as towards the top of the page in FIG. 1. In this example, the retention projection extends perpendicular to a side of the closure that is parallel to the wall 2 when the closure is received within the tube formed by the wall 2 and this perpendicular surface provides the engagement surface 8 to catch under an upper edge, as shown in FIG. 1, to retain the closure 4 in the tube. The closure is thereby secured over the container aperture to enclose the contained region 14.

The container 1 of the embodiment shown in FIG. 1 has a registering surface 9 defined by the wall. The registering surface 9 engages a registering surface 10 provided on the retention projection 6. The registering surfaces 9 and 10 will engage when the closure is twisted relative to the wall 2 to force the surfaces 9 and 10 together. In this scenario the registering surface 9 on the projection 6 and registering surface 10 defined by the aperture 5 will impede further relative twisting in one direction. An operator will be able to feel the engagement and impeded motion. Therefore, the container provides feedback which registers that the retention projection 6 is received in the retention aperture 5 with registering surfaces 9 and 10 abutted. When the retention projection 6 is received in the retention aperture 5 and registered the retention surfaces 7 and 8 are aligned and engaged against removal of the closure from the wall 2. Therefore, the action of the registration surfaces 9 and 10 register that the closure 4 is secured and the container is securely closed.

Also shown in FIG. 1 a disengagement surface 11 is formed on the retention projection 6. The disengagement surface 11 of this embodiment is an surface formed on the projection 6 which inclines from a radial extremity of the projection 6 inwards towards a central axis of the closure 4 in a direction in which the closure 4 should be twisted to release the retention projection 6 from the retention aperture 5. This allows the projection 6, and rest of the closure, to slide relatively past the engagement aperture 5 to allow the retention surface 7 to move out of alignment, in an axis across the page as shown, with the retention surface 8 so that the surfaces 7 and 8 are disengaged and the closure 4 is not impeded from being moved in a direction away from the container aperture 3 to remove the closure 4 from the aperture. This allows the container 1 to be opened by moving the closure in a direction of removal 15.

In this example the retention aperture 5 is formed as a cut-out of the wall and the aperture 5 has an edge which forms a surface similar to the registering surface 9. The retention projection 6 of this example extends radially from the closure 4 which is formed in a complementary shape to the wall 2 to a radial extremity. The disengagement surface 11 inclines radially to present a ramp to the edge of the aperture 5 so the projection 6 slides out and past the aperture 5 to disengage retention surfaces 7 and 8.

Figure 2:
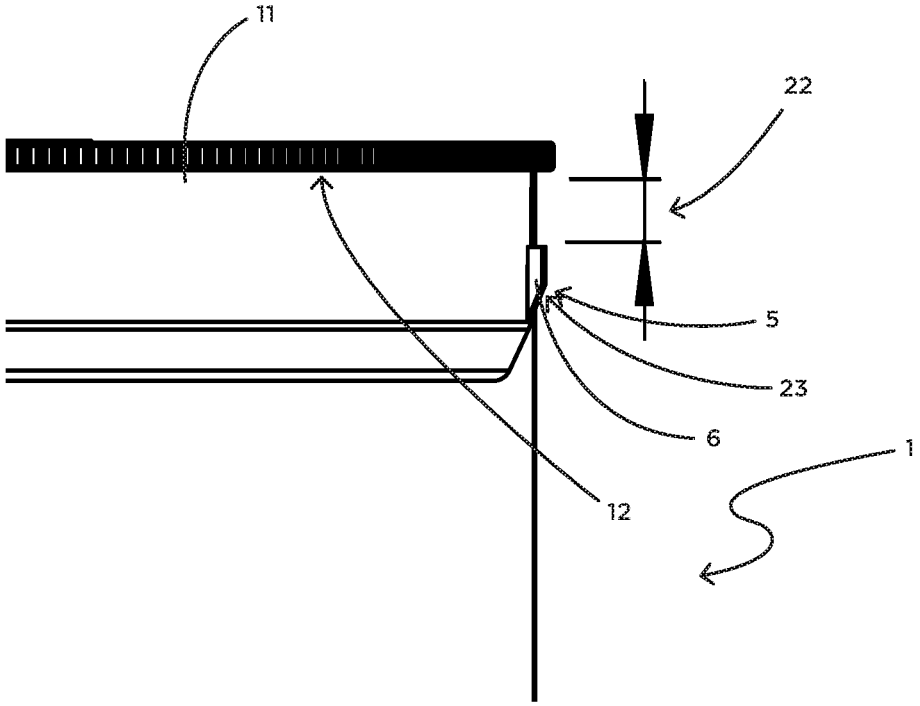
FIG. 2 shows a side elevation of the container of FIG. 1 from a different angle.

FIG. 2 shows the container of FIG. 1 rotated about a central axis of the tube relative to the view of FIG. 1. FIG. 2 more clearly shows the retention projection 6 as extending radially to the main body of the closure 4 and through the retention aperture 5. Also clearly shown in FIG. 2 is a lip 12 formed on the closure to engage an edge 12 of the wall 2. The lip is located a distance 22 from the retention projection 6 that arranges the projection 6 to be aligned, vertically as shown in FIG. 2, with the retention aperture 5 when the closure 4 is pushed as far towards the contained region as the lip 12 will allow. Specifically, the lip 12 is formed a distance 22 that is arranged so the engagement surfaces of the closure and wall to be aligned so that they can engage by the closure being twisted relative to the wall 2.

Figure 3:
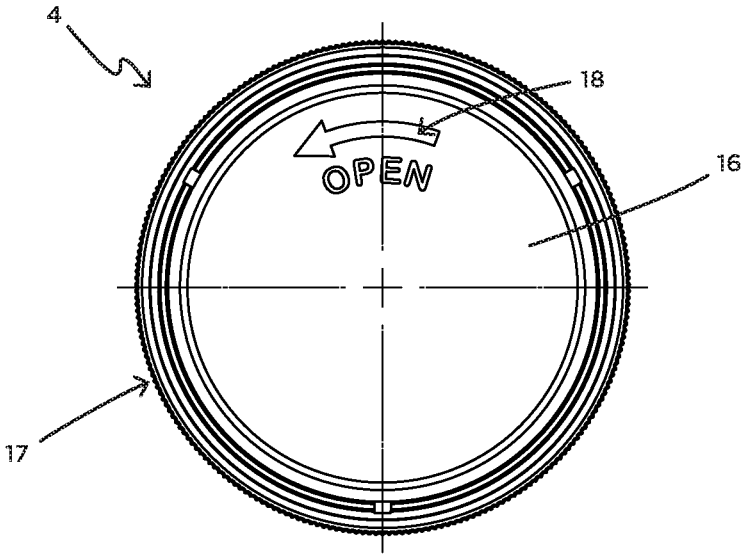
FIG. 3 shows a plan view of a closure of the embodiment of FIG. 1.

FIG. 3 shows plan view of the closure 4 of FIG. 1 and FIG. 2. As shown the closure 4 has a barrier 16 to close the closure aperture 3 when the closure is in place and to provide a barrier to egress items from the contained region 3.

Also shown in FIG. 3 is a grip profile 17 formed on an outer edge of the closure 4 to facilitate an operator twisting the closure by tangential force or torque on the closure 4. The closure 4 is shown with indicator markings showing the direction of twist 18 of the closure 4 relative to the wall 2 to open the closure by sliding, in this example, the disengagement surface 11 over an edge of the retention aperture 5 to move the retention surfaces 7 and 8 out of alignment so the container 1 can be opened by pulling the closure 4 in a direction away from the closure region, out of the page as shown. FIG. 3 also shows a direction of twist 18 which will engage the registering surfaces 9 and 10 if the retention surfaces 7 and 8 are aligned, into the page as shown in FIG. 3, by the lip 12 abutting an edge of the wall 2. As the reader will appreciate, the retention surfaces 7 and 8 when the retention projection 6 is received in the retention aperture 5.

Figure 4:
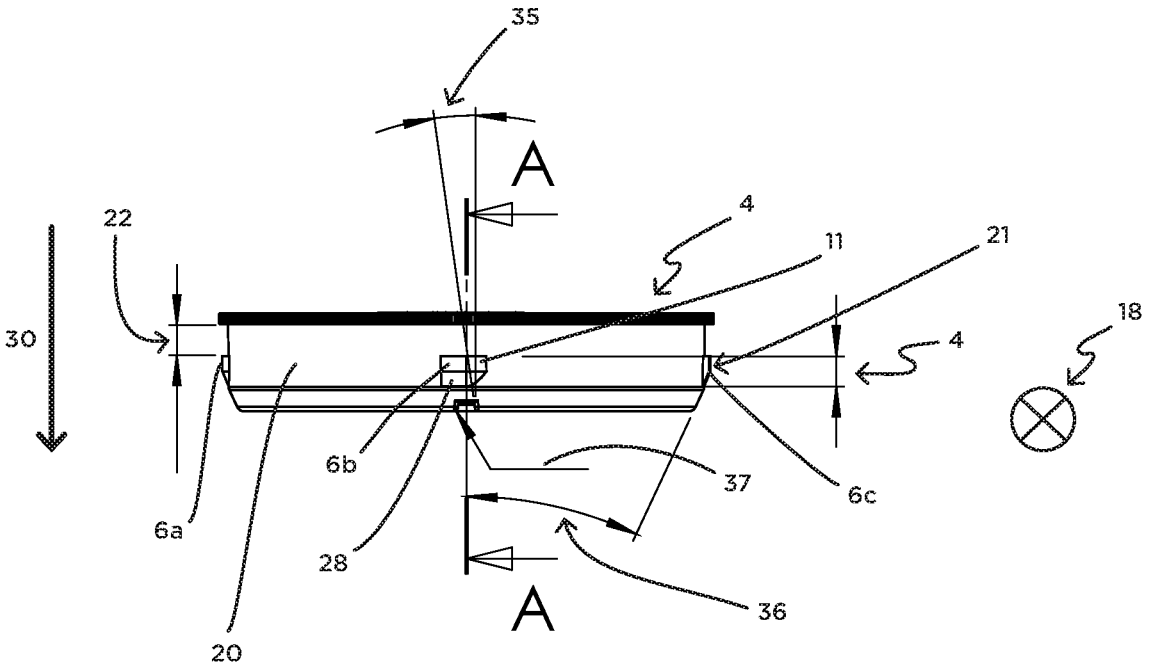
FIG. 4 shows a side elevation of a closure of the same embodiment of the invention.

FIG. 4 shows a side elevation of the closure of FIGS. 1 to 3. FIG. 4 shows three, of four retention, projections 6*a* to 6*c* extending radially from the closure 4. Also shown in FIG. 4 is the disengagement surface 11 as a surface inclining from a radial extremity 21 of a projection 6 to the wall 20 of the closure 4 in the direction 18 into the page as shown.

Also shown in FIG. 4 is the projection 6 separated from the lip 12 by a distance 22 which aligns the retention surfaces 7 and 8 in a closing direction 30 shown down the page in FIG. 4 or towards the interior of the container 1. The retention surface 8 of the closure 4 is located a distance from the lip 12 that is substantially the same distance, plus a tolerance, that the retention surface 7 of the wall 2 is located from the edge 23 of the wall abutted by the lip 12. This means that when the lip 12 is abutted with the edge of the wall 2 the retention surfaces 7 and 8 can be brought into alignment merely by an operator twisting the closure 4 relative to the wall 2 in the direction of twist opposite to direction 18 until the registering surfaces 9 and 10 abut to register that the retention surfaces 7 and 8 are aligned to engage and prevent movement of the closure in a direction away from the contained region.

Figure 5:
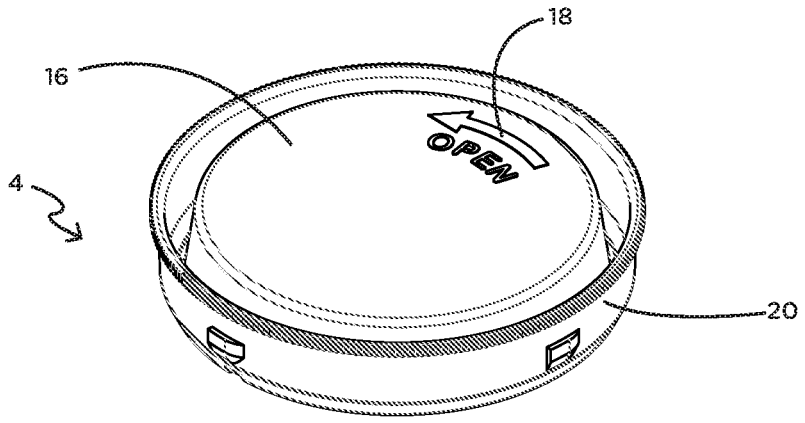
FIG. 5 shows a perspective view of a closure of the same embodiment of the invention.

FIG. 5 gives a perspective view of the closure of FIGS. 3 and 4. FIG. 5 shows a closure barrier 16 which covers, in this example, most of the container aperture (not shown) and retains items in the container region (not shown). Retention projections 6*a* and 6*b* are shown in FIG. 5 extending from a closure wall 20 which has a shape which is complementary to the wall 2 of the container 1. In this example the wall defines a cylinder or tube and the closure 4 resembles a plug for an end of the tube. In this example also the barrier 16 is connected to the closure wall 20 by an annular U-shaped surface 26. FIG. 5 shows the retention surface 10. The disengagement surface 11 sloping in the direction 18 from the closure wall 20 to a radial extremity 21 of the projection 6. Shown in FIG. 6 is an insertion surface 28 which slopes from the closure wall 20 to the radial extremity 21 of the projection 6 in a direction 30 in use towards the container region 3, or down the page as shown in FIG. 5.

The insertion surface 28 provides a ramp to facilitate the retention projection 6 sliding past the of the wall 2 to prevent the projection 6 catching on the and impeding movement of the closure 4 towards the contained region to close the container 1.

Figure 6:
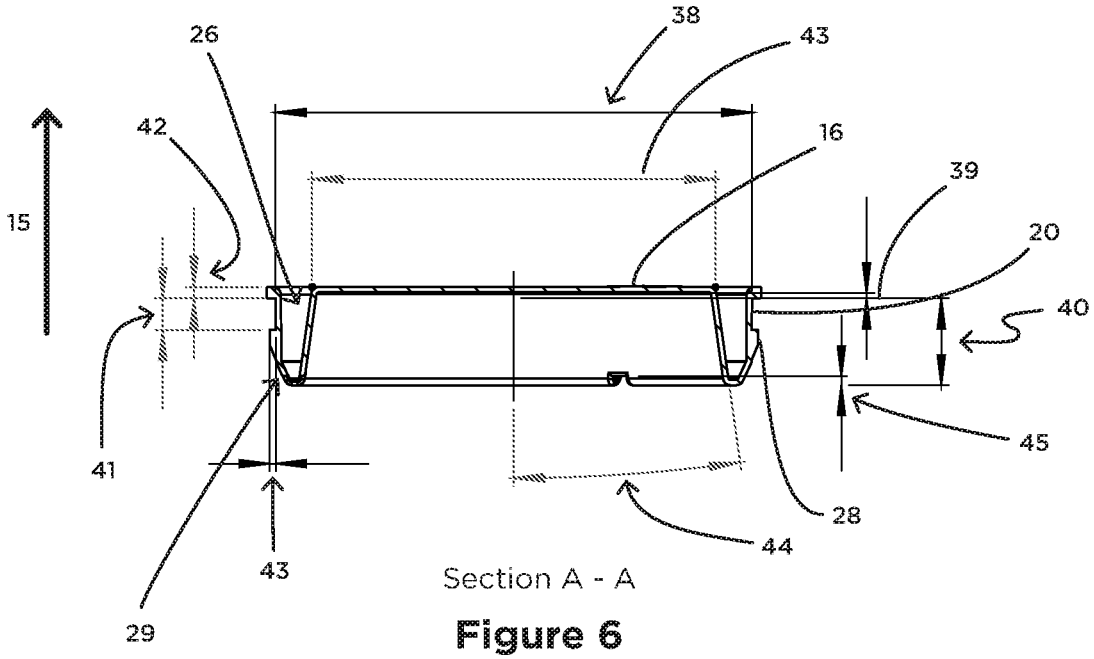
FIG. 6 shows a cut-away side elevation of the closure of the embodiment of FIG. 1.

FIG. 6 gives a cut-away side elevation of the closure 4, showing the barrier 16, closure wall 20, U-shaped surface 26, and retention projections 6*a* and 6*c*. Clearly shown in FIG. 6 is a tapered surface 29 defined by the U-shaped surface. The tapered surface 29 is located at the end on the closure 4 that leads in a direction opposite to 15 and towards the container region 3 in use. The tapered section extends inwards towards a central axis of the closure as it extends in direction 15 in use to facilitate, in this embodiment, insertion of the closure 4 into the container aperture.

Operation of the container of another embodiment of the invention will be described below in reference to FIGS. 7 to 11.

Figure 7:
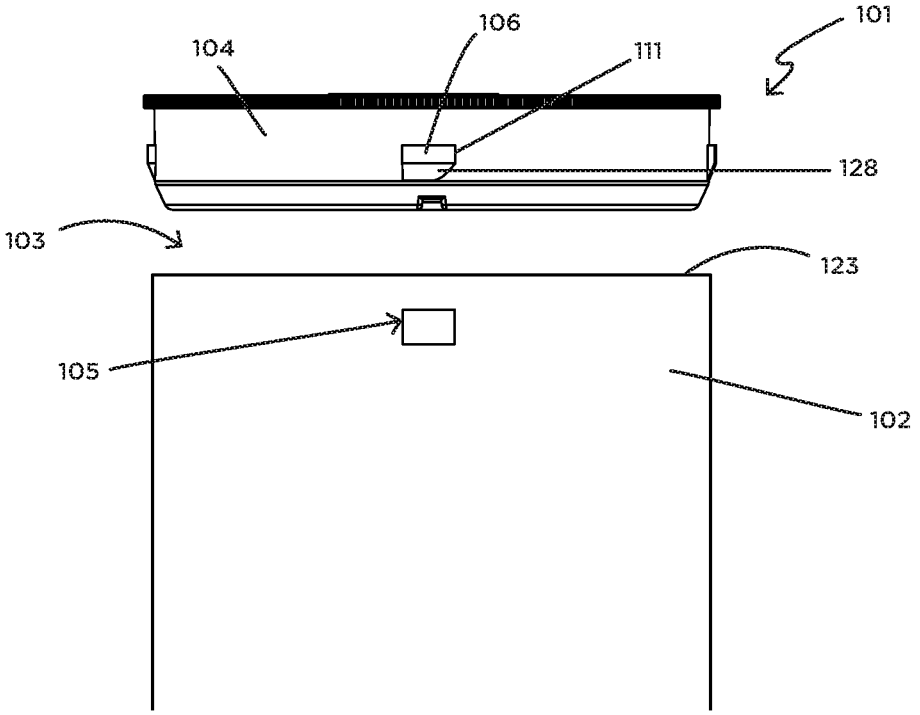
FIG. 7 shows a side elevation of a container with closure of another embodiment of the invention.

FIG. 7 shows a side elevation of the container 101 in which a closure 104 is suspended over and slightly away from the wall 102 defining aperture 103 with wall edge 123.

Figure 8:
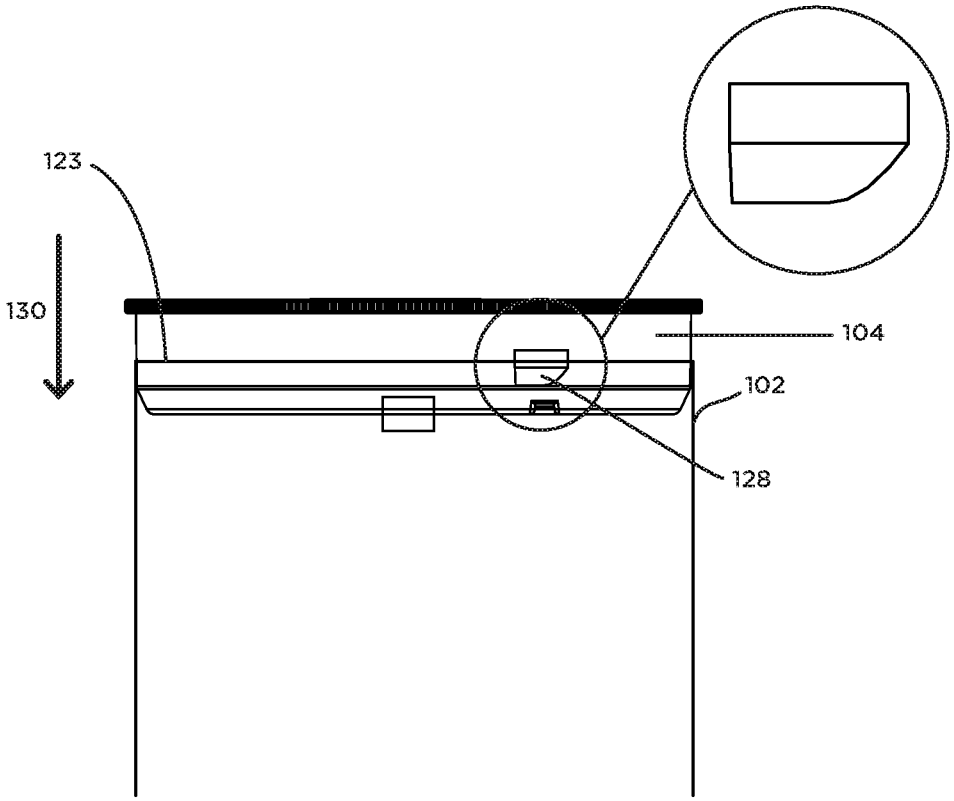
FIG. 8 shows a side elevation of a container of the same embodiment as FIG. 7 in a different configuration.

FIG. 8 shows the container 101 with closure 104 having moved in closing direction 130, towards the contained region. The closure 104 is shown covering the aperture 103 with the closure 104 partially inserted into the aperture 103. The sloped insertion surface 128 of the projection 106 is shown partially under an edge 123 of the wall 102 allowing the retention projection 106 to slide past the edge 123 of the wall.

Figure 9:
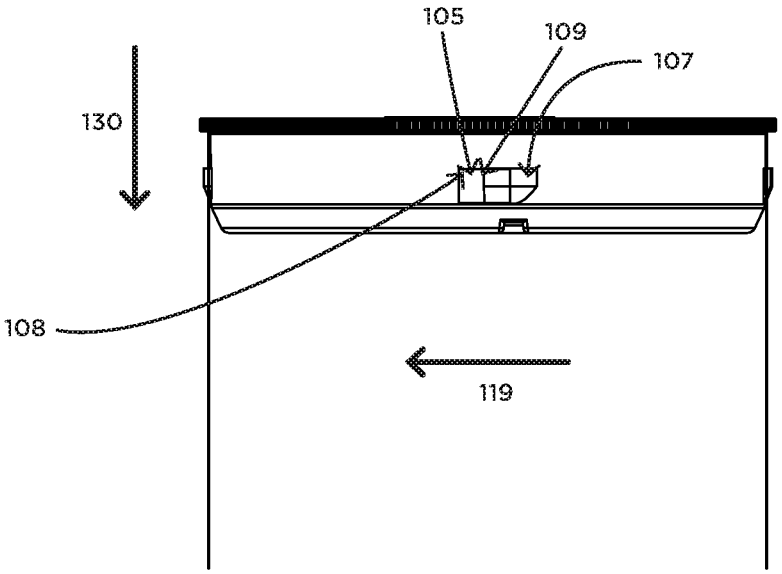
FIG. 9 shows a side elevation of a container of the same embodiment as FIG. 7 in a different configuration.

FIG. 9 shows the closure fully inserted into the closure aperture 103 and having been rotated in direction 119, by twisting action provided by an operator (not shown). The retention projection 106 is shown transversely aligned with the retention aperture 105 so the retention surface 107 is transversely aligned, apart from a tolerance offset, with the retention surface 108. The retention projection is shown only partially aligned longitudinally with the retention aperture in FIG. 9.

Similarly, the retention surface of the closure is partially aligned transversely with the retention surface of the wall. The registering surface of the projection is shown displaced from the registering surface of the retention aperture. This allows continued rotation, by twisting action, in direction 119 without the container registering that the retention surfaces are aligned longitudinally.

Figure 10:
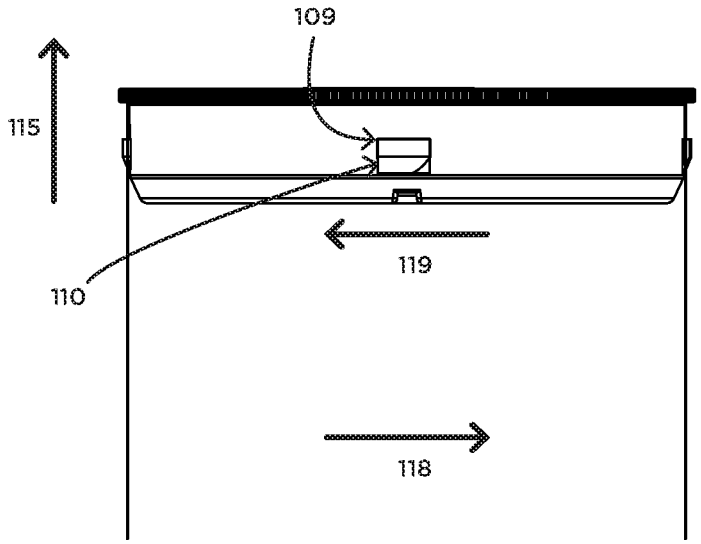
FIG. 10 shows a side elevation of a container of the same embodiment as FIG. 7 in a different configuration.

FIG. 10 shows the container with the closure having been twisted further in direction 119 until the registering surface of the projection and the registering surface of the aperture top register that the 106 projection is longitudinally aligned with the retention aperture 105.

Figure 11:
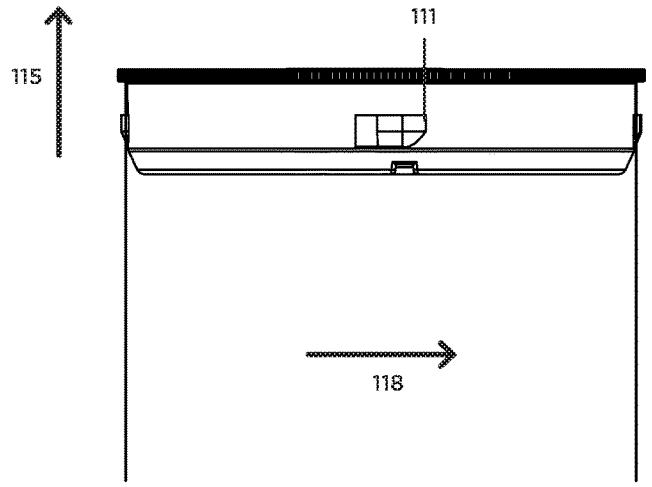
FIG. 11 shows a side elevation of a container of the same embodiment as FIG. 7 in a different configuration.

FIG. 11 shows the container with the closure having been twisted in direction 118 to cause the disengagement surface to slide past an edge of the aperture to allow the retention projection to be partially removed from the retention aperture. Further twisting of the closure 104 would move the retention surface of the projection to be dis-aligned longitudinally with the retention surface of the aperture so that the retention surfaces do not prevent the closure being removed from the rest of the container by movement in direction 115.

The reader will appreciate that the disengagement surface formed on the retention projection as a ramp or inclined surface on a side of the retention projection opposite the registering surface will provide a one-way mechanism that allows twisting of the closure through a rotation in only one direction. The closure is free to be twisted relative to the wall freely in one direction.

The reader will also appreciate that the insertion surface 28 formed on the retention projection 6 on a side opposite the retention surface 8 will avoid an edge of the wall defining the container aperture 3 impeding movement of the closure 4 towards the interior of the contained region while allowing the retention surface 8 to engage the retention surface 8 to impede movement of the closure 4 away from the contained region. The retention projection provides a one-way mechanism for movement of the closure when the retention projection is radially aligned with the retention aperture but allows two-way movement when these are not aligned.

The reader will appreciate that the retention projection defining retention surface, insertion ramp, registering surface and disengagement allow the closure to be moved towards the contained region with any rotational alignment of the closure and wall, secured by twisting in one direction until the twisting is impeded, and released by twisting in the opposite direction by a small degree to disengage the registering projection then moving the closure away from the contained region.

Figure 12:
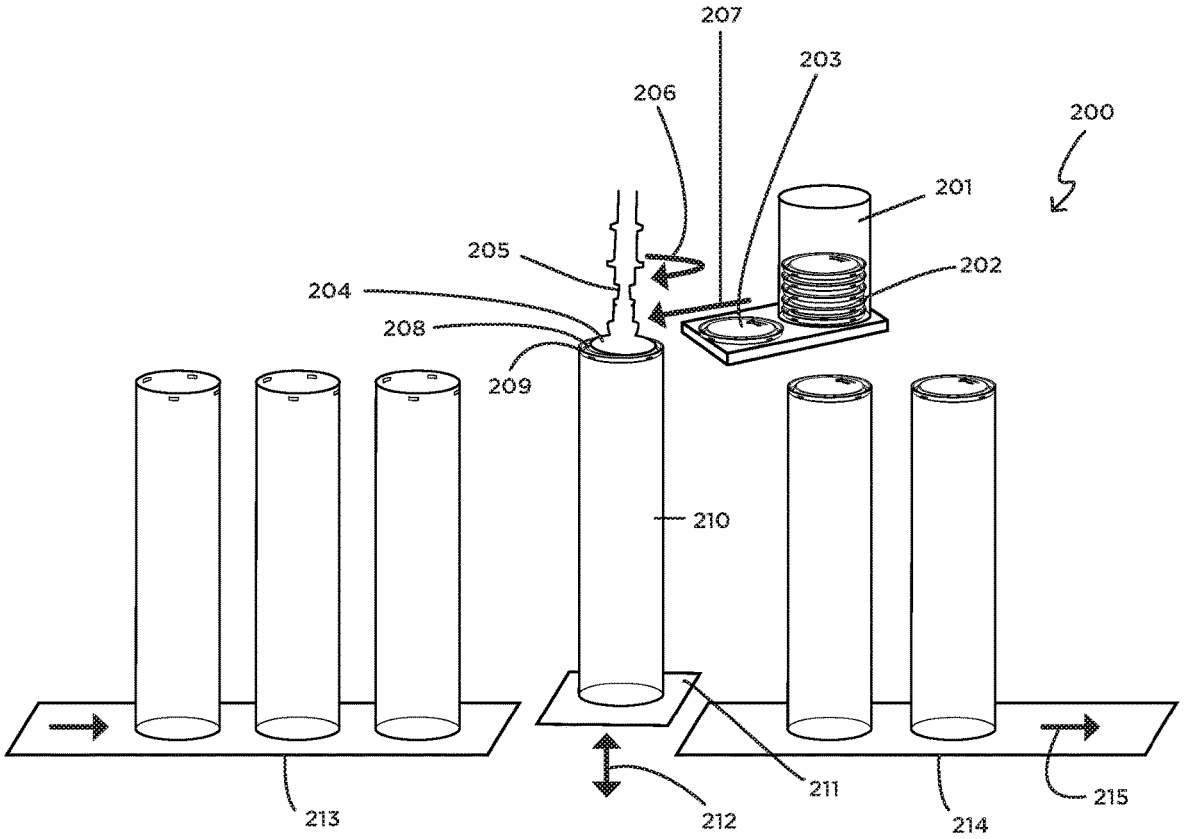
FIG. 12 shows an apparatus according to a further embodiment which closes containers according to embodiments of FIGS. 1 to 6 or FIGS. 7 to 11.

FIG. 12 shows an apparatus which is operable to close containers of the embodiments of FIGS. 1 to 6 or of FIGS. 7 to 11.

The apparatus 200 has a magazine 201 which holds a stack of closures 202 from which a closure 203 is released. The released closure 202 is engaged by a closure holder 204, which is a suction element connected to a vacuum source in this embodiment. The suction element 204 is mounted on an arm, or rod 205 which is operable to rotate in one direction 206.

The tube 210 is mounted on a platform 211 movable in axis 212 to move the closure relatively towards an interior of the tube 210.

The tubes 210 are fed to the platform by a conveyor 213 and fed from the platform by conveyor 214, each in direction 215.

The apparatus provides an automated process for closing containers with minimal types of movements needed. The arm 205 need only rotate in one direction. The apparatus 200 does not require any means to rotationally align a closure 208 with a tube 210. The apparatus 200 need only have two sensors to sense whether the lip on the closure 208 has abutted an edge of the tube 209 and to sense whether registering surfaces (not shown) of the closure 208 and tube 210 have abutted to register that a retention projection (not shown) is received in a retention aperture to secure the closure in place.

Figure 13:
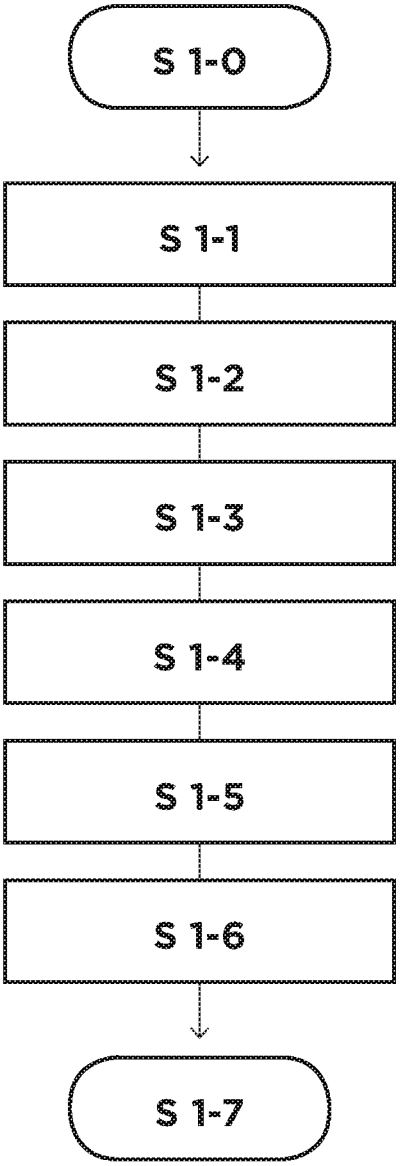
FIG. 13 illustrates a process according to a further embodiment of the invention.

FIG. 13 illustrates a process for closing a container using a closure in accordance with the embodiment of FIGS. 1 to 12.

In step S1-0 the process starts.

In step S1-1 a closure 4 is removed from a stack of closures using a suction cup applied to the top surface of the barrier 16 of the closure to retain the closure in engagement with a holding element.

In step S1-2 containers 1 to be closed, the form of tubes, are provided on a conveyor.

In step S1-3 the containers 1, and specifically the aperture 3, are lined approximately axially with the closure 4. The approximate alignment accommodates a tolerance in machine alignment provided by the tapered surface 29 on the closure 4.

In step S1-4 the closure 4 is pressed by the apparatus towards the interior of the container 1 until the lip 12 abuts the top edge of the wall 2 to provide a resisting force to further movement of the closure towards the contained region defined by the wall. The abutment of the lip 12 and wall 2 provide the apparatus with feedback that the engagement surface 8 is aligned axially with the tube with an upper edge of the retention aperture 5.

In step S1-5 the closure 4 is twisted relative to the container 1, axially about a central axis of the container 1 in a closing rotational direction, or sense, until the registering surfaces 9 and 10 abut and provide a force resisting further twisting to provide feedback to the apparatus that the engagement surface 8 is aligned with an upper edge of the retention aperture 5 so as to prevent removal of the closure 4 from the container 1 in an opening direction.

In step S1-6 the apparatus releases the suction cup from the closure 4 when a force resisting further twisting is provided by abutment of the registering surfaces.

The process ends at step S1-7.

Further and additional embodiments will now be described and illustrated.

In alternative embodiments the retention, engagement and/or registering surfaces illustrated above as provided on one or other of the wall or closure are alternatively provided on the other of the wall or closure.

In alternative embodiments the insertion surface formed on the retention projection may be omitted.

In alternative embodiments an engagement surface, or the retention surface, illustrated as provided on the wall are alternatively provided on the closure.

In alternative embodiments a registering surface illustrated as provided on the wall are alternatively provided on the closure.

In alternative embodiments registering surface illustrated as provided on the closure is alternatively provided on the closure.

An operator can insert the closure into the container aperture and twist in a second direction until they feel further twisting being impeded to register that the closure is retained over the closure aperture by the first and second engagement surfaces.

Embodiments of the invention provide a container with a wall defining a container aperture and with a closure wherein the closure can be twisted in a first direction to slide a first engagement surface relatively past a second engagement surface to configure the first and second engagement surfaces to not engage when the closure is moved in a direction away from the interior of the container to allow the closure to be removed from a closure aperture. This action may open the container.

In alternative embodiments the closure may not fit within the closure aperture defined by the wall and may, alternatively, fit over the wall.

In some embodiments the closure wall, similar to the wall 20 of FIG. 5, may be formed of resilient material that provides a biasing force and/or a tight fit between the closure and the container wall.

Embodiments of the invention provide a container with a wall defining a container aperture and with a closure wherein the closure is able to be inserted into a container aperture and twisted in a second direction to engage registering surfaces of a wall of the container and the closure to provide feedback to an operator that engagement surfaces on the wall and the closure are aligned to engage against movement of the closure in a direction out of the container. This action may close the container.

The reader will appreciate that embodiments illustrated with reference to FIG. 12 allow the closure of a container with alignment of the closure 4 and container 1 that accommodates a tolerance. The reader will appreciate that the apparatus required to close the containers requires only a degree of freedom in twisting the closure 4 relative to the container 1 in only one direction. The reader will also appreciate that a simple force sensor using feedback from the registering surfaces is required to control the machine to cease twisting. The reader will also appreciate that the same closure, adapted for closure by a simple, cost-effective apparatus is readily opened by an end user by twisting the closure 4 relative to the container 1 in the only direction it will twist and then pulling the closure 4 from the aperture 3.

In the embodiment illustrated any angles and dimension known as suitable to the reader for a given application may be used. In an alternative embodiment described now with reference to FIGS. 4 and 6, the following dimensions and angles are illustrated. FIG. 4 shows and angle 35 of 8 degrees, another angle 36 of 25 degrees. FIG. 6 shows dimensions for this particular embodiment of 39 of 63 mm+/−0.05=n, dimension 43 of 53.3 mm, dimension 39 of 0.7 mm, dimension 40 of 11.5 mm, dimension 41 of 4.2 mm, dimension 42 of 1.5 mm, dimension 43 of 0.8 mm, angle 44 of 8 degrees and dimension 45 od 1.2 mm.

Various alternative embodiments to those described and illustrated with reference to FIGS. 1 to 13 will have any dimensions and angles as alternatives to those described and illustrated herein.

Containers of Various embodiments of the invention are used for packaging fruit. Various embodiments relating to processes close containers with fruit.

Various embodiments provide a packaged fruit product having fruit contained in the contained region and retained by the closure.

As used herein the term "a" is intended to mean one or more and is not intended to exclude "another".

In the preceding description and the following claims, the word "comprise" or equivalent variations thereof is used in an inclusive sense to specify the presence of the stated feature or features. This term does not preclude the presence or addition of further features in various embodiments.

It is to be understood that the present invention is not limited to the embodiments described herein and further and additional embodiments within the spirit and scope of the invention will be apparent to the skilled reader from the examples illustrated with reference to the drawings. In particular, the invention may reside in any combination of features described herein or may reside in alternative embodiments or combinations of these features with known equivalents to given features. Modifications and variations of the example embodiments of the invention discussed above will be apparent to those skilled in the art and may be made without departure of the scope of the invention as defined in the appended claims.

What is claimed is:

1. A container comprising a wall and a closure, wherein the wall is formed of a sheet of material and defines a contained region and also defines a container aperture to receive items into the contained region, the container comprising a closure adapted to cover the container aperture to close the container, wherein the wall defines a retention aperture and the closure defines a retention projection dimensioned to be received in the retention aperture to retain the closure over the container aperture when a retention surface defined by the retention projection engages a retention surface defined by the wall at an edge of the retention aperture, wherein the retention projection defines an insertion surface which provides a ramp to avoid the closure being impeded by an edge of the wall in a direction towards the contained region, the insertion surface being located on the retention projection opposite the retention surface, wherein the retention projection defines a disengagement surface which provides a ramp to remove the retention projection from the retention aperture as the closure is twisted in a first direction relative to the wall, and wherein the retention projection defines a registering surface arranged transverse to the retention surface so as to abut a registering surface defined by the wall at another edge of the retention aperture when the closure is rotated in a second direction relative to the wall to provide, wherein the registering surface is located on the retention projection opposite to the disengagement surface to provide a one-way mechanism for twisting movement of the closure when the retention projection is radially aligned with the retention aperture, wherein the container may be closed by i) covering the container aperture with the closure irrespective of the rotational alignment of the closure relative to container, by ii) moving the closure towards the contained region and then iii) twisting the closure in a second direction relative to the wall until resistance is provided by the registering surface of the retention projection abutting the registering surface of the wall at said edge of the retention aperture.

2. The container of claim 1, wherein the registering surface defined by the retention projection is arranged to abut the registering surface defined by the retention aperture when the retention surface defined by the retention projection is aligned with the retention surface defined by the retention aperture.

3. The container of claim 1 wherein the disengagement surface comprises a surface inclining away from the centre of the container region to allow twisting of the closure relative to the wall to slide the second engagement surface to a location past the first engagement surface.

4. The container of claim 1 wherein the inclined disengagement surface may be arranged to remove the projection from the aperture as the closure is twisted relative to the wall in a first direction of rotation to allow the projection to move relatively past the aperture.

5. The container of claim 1 comprising a first alignment surface on the wall and a second alignment surface on the closure, wherein the first and second alignment surfaces are adapted to engage when the closure is pushed towards an interior of the container to align the retention projection and retention aperture so as to allow insertion of the retention projection into the retention aperture by the closure being twisted relative to the wall.

6. The container of claim 5 wherein the second alignment surface is a lip formed on the closure.

7. The container of claim 5 wherein the first alignment surface is an edge of the wall.

8. A closure arranged to close a container having a wall formed of a sheet of material which defines a contained region and a retention aperture, wherein the retention aperture provides a retention surface and a registering surface, wherein the closure is adapted to cover the container aperture to close the container, wherein the closure defines a retention projection dimensioned to be received in the retention aperture to retain the closure over the container aperture when a retention surface defined by the retention projection engages a retention surface defined by the wall at an edge of the retention aperture, wherein the retention projection defines an insertion surface which provides a ramp to avoid the closure being impeded by an edge of the wall in a direction towards the contained region, the insertion surface being located on the retention projection opposite a retention surface arranged to engage the wall at an edge of the retention aperture, wherein the retention projection defines a disengagement surface adapted to remove the retention projection from the retention aperture as the closure is twisted in a first direction relative to the wall, and wherein the retention projection defines a registering surface arranged transverse to the retention surface to engage a registering surface defined by the wall at another edge of the retention aperture, wherein the disengagement surface is located on the retention projection opposite the registering surface.

9. A container comprising a wall formed of a sheet of material which defines a container aperture to receive items into a contained region defined by the wall, the container comprising a closure adapted to cover the container aperture to close the container, wherein the wall defines a retention aperture and the closure defines a retention projection dimensioned to be received in the retention aperture to retain the closure over the container aperture when a retention surface defined by the retention projection engages a retention surface defined by the wall at an edge of the retention aperture, wherein the retention projection defines an insertion surface which provides a ramp to avoid the closure being impeded by an edge of the wall in a direction towards the contained region, the insertion surface being located on the retention projection opposite the retention surface, wherein the retention projection defines a disengagement surface which provides a ramp to remove the retention projection from the retention aperture as the closure is twisted in a first direction relative to the wall, and wherein the retention projection defines a registering surface arranged transverse to the retention surface to abut a registering surface defined by the wall at another edge of the retention aperture when the closure is rotated in a second direction relative to the wall, wherein the disengagement surface is located on the retention projection opposite the registering surface, whereby the container may be closed by covering the container aperture with the closure irrespective of the rotational alignment of the closure relative to container, by moving the closure towards the contained region and then twisting the closure in a second direction relative to the wall until resistance is provided by the registering surface of the retention projection abutting the registering surface of the wall at said edge of the retention aperture.

* * * * *